United States Patent [19]

Hansen et al.

[11] Patent Number: 4,813,392

[45] Date of Patent: Mar. 21, 1989

[54] ROTARY VALVE ASSEMBLY

[75] Inventors: Craig N. Hansen, Minnetonka; Paul C. Cross, Minneapolis, both of Minn.

[73] Assignee: Hansen Engine Corporation, Minnetonka, Minn.

[21] Appl. No.: 216,535

[22] Filed: Jul. 8, 1988

Related U.S. Application Data

[60] Continuation-in-part of Ser. No. 671,573, Nov. 15, 1984, Pat. No. 4,612,886, which is a division of Ser. No. 899,157, Aug. 22, 1986, Pat. No. 4,773,364.

[51] Int. Cl.[4] ..... F01L 7/16

[52] U.S. Cl. ..... 123/190 E; 123/190 BD

[58] Field of Search ..... 123/80 R, 80 BB, 80 D, 123/80 DA, 190 R, 190 B, 190 BD, 190 BE, 190 C, 190 D, 190 E; 251/174, 180, 185, 304, 309, 314, 316

[56] References Cited

U.S. PATENT DOCUMENTS

| | | | |
|---|---|---|---|
| 1,042,712 | 10/1912 | Moorhead | 123/190 BB |
| 1,170,769 | 2/1916 | Mayfield | 123/190 BD |
| 1,215,993 | 2/1917 | Rimbach | 123/190 A |
| 1,292,597 | 1/1919 | Gill | 123/190 D |
| 1,581,942 | 4/1926 | Rich | 123/190 BB |
| 1,632,517 | 6/1927 | Stickney | 123/190 D |
| 1,651,207 | 11/1927 | Hodges | 123/190 DL |
| 1,692,235 | 11/1928 | Wehr | 123/190 BD |
| 1,700,862 | 2/1929 | Thompson | 123/190 R |
| 1,719,508 | 7/1929 | Good | 123/190 D |
| 1,724,458 | 8/1929 | Davidson | 123/190 BB |
| 1,733,946 | 10/1929 | Meester, Jr. | 123/190 BF |
| 1,758,242 | 5/1930 | Wehr | 123/253 |
| 1,782,389 | 11/1930 | Rauha, Jr. et al. | 123/190 A |
| 1,971,060 | 8/1934 | Wills | 123/190 E |
| 2,017,196 | 10/1935 | Anglada et al. | 123/190 E |
| 2,222,059 | 11/1940 | Monleone | 123/190 D |
| 2,245,743 | 6/1941 | Aspin | 123/190 D |
| 2,395,994 | 3/1946 | Davies | 123/190 C |
| 2,437,181 | 3/1948 | Baker | 123/190 BD |
| 2,471,941 | 5/1949 | Downey | 251/113 |
| 2,500,794 | 3/1950 | Boyce | 123/80 DA |
| 2,730,088 | 1/1956 | Hyde | 123/190 A |
| 3,039,448 | 6/1962 | Stucke | 123/190 D |
| 3,130,953 | 4/1964 | Carpenter | 123/190 D |
| 3,395,680 | 8/1968 | Brooks | 123/190 A |
| 3,395,889 | 8/1968 | Chovan | 251/314 X |
| 3,489,158 | 1/1970 | MacKay et al. | 251/314 X |
| 4,019,488 | 4/1977 | Kremer | 123/190 BB |
| 4,036,184 | 7/1977 | Guenther | 123/190 E |
| 4,311,119 | 1/1982 | Menzies et al. | 123/190 BD |
| 4,404,934 | 9/1983 | Asaka et al. | 123/190 BD |
| 4,467,751 | 8/1984 | Asaka et al. | 123/190 E |
| 4,494,500 | 1/1985 | Hansen | 123/190 E |

FOREIGN PATENT DOCUMENTS

| | | |
|---|---|---|
| 492380 | 3/1954 | Italy . |
| 401985 | 11/1933 | United Kingdom . |
| 570354 | 7/1945 | United Kingdom . |
| 1479347 | 7/1977 | United Kingdom . |

*Primary Examiner*—Willis R. Wolfe

*Attorney, Agent, or Firm*—Burd, Bartz & Gutenkauf

[57] ABSTRACT

An internal combustion engine having a heat with valve assemblies for controlling intake and exhaust gases to and from piston chambers. A head plate is located between the head and a block having cylinders accommodating pistons. The head plate has openings in communication with the cylinders and valve assemblies. Each valve assembly has a continuous ceramic sleeve having an intake port, an exhaust port, and ignition hole. Rotatably disposed within the sleeve is a rotatable valve body having a valving combustion chamber open to a piston chamber. A ceramic segment seal member movably mounted on the valving body has sealing surfaces engageable with the sleeve. A face seal is located between the head plate and the rotating valve body. The valving body and seal member are rotatably driven to sequentially align the valving combustion chamber with the intake port, ignition hole, and exhaust port during the operation of the engine.

35 Claims, 9 Drawing Sheets

ROTARY VALVE ASSEMBLY

This invention was made with government support under Contract No. DAAE 07-84-C-R-089 awarded by the Department of Army. The government has certain rights in this invention.

CROSS REFERENCE TO RELATED APPLICATION

This application is a continuation-in-part of U.S. application Ser. No. 671,573 filed Nov. 15, 1984, now U.S. Pat. No. 4,612,886, which is a divisional of application Ser. No. 897,157 filed Aug. 22, 1986, now U.S. Pat. No. 4,773,364.

FIELD OF INVENTION

The invention pertains to a rotary valve assembly usable with an internal combustion engine, fluid motor, or gas compressor to control the flow of intake and exhaust gas.

BACKGROUND OF INVENTION

Rotary valves have been proposed for use with internal combustion engines. These valves having valving members drivably connected to the crankshafts of the engine to sequentially allow intake gas, such as an air and fuel mixture, to flow into the engine and exhaust gas to flow out of the engine. An example of a rotary valve mechanism for an internal combustion engine is described by Carpenter In U.S. Pat. No. 3,130,953. This valve mechanism has a rotary valve body rotatably located in a head. The head is mounted atop a cylinder. A self-sealing split sleeve device associated with the body functions as a valving member and seal. The sleeve is a metal cylindrical member having a hole and a longitudinal split. In use the sleeve deforms outwardly into circumferential surface sealing engagement with an inside cylindrical wall of the head to close the intake and exhaust ports. Hodges in U.S. Pat. No. 1,651,207 discloses an internal combustion engine having a rotary valve located over the piston. The valve has a port open to the piston chamber that is sequentially moved into alignment with intake, ignition and exhaust ports. The outer surface of the valve is in surface engagement with the head.

Ceramic materials have been developed for parts of turbine engines and internal combustion engine. Engine designs must accommodate the mechanical, heat, and lubricating characteristics of the ceramic materials. The rotary valve assembly of the present invention has ceramic parts that are compatible with the material of the head, cylinder, and piston of the engine.

SUMMARY OF INVENTION

The invention is directed to rotary valve assemblies and a head for an apparatus, as an internal combustion engine or a gas compressor, having rotary valve assemblies for controlling intake and exhaust gases. The valve assemblies are usable as a substitute for the conventional poppet valves and cam shaft arrangements used in internal combustion engines. The valve assemblies have a simplified construction which can be readily serviced and maintained. In operation, the valve assemblies are usable with high speed engines and gas compressors. The conventional problem with valve float associated with poppet valves is not present in the rotary valve assembly.

The internal combustion engine has a block with a plurality of bores accommodating reciprocating pistons. These bores and pistons provide the piston or compression and expansion chambers for accommodating the burning air/fuel mixture and exhaust gases. The rotary valve assemblies are located in a head and are concurrently driven with a valve drive operatively connected to the crankshaft of the engine. A head plate has openings providing communication between the rotary valve assemblies and the piston compression and expansion chambers. The head plate reduces the thrust and lateral forces on the rotary valve assemblies and minimizes the quenched volume of air and fuel mixture adjacent to the valving combustion chambers. Substantially all of the air/fuel mixture in the valving combustion chamber is exposed to the flame front with a result in reduction of HC emissions and improved fuel economy. A spark generating means is mounted on the head and extended into the ignition hole to ignite the air/fuel mixture in the valving combustion chamber. A fuel injector can be mounted on the head in lieu of the spark plug when the engine is a Diesel engine, or in conjunction with spark generating means in the case of a fuel injected spark ignition engine.

The head has a plurality of bores open to the piston compression and expansion chambers in the block. The bores can be larger than the openings in the head plate. Intake and exhaust gas passages located in the head are open to separate portions of each bore. Each bore accommodates a continuous sleeve having an intake port, an exhaust port, and an ignition hole and/or fuel injection port. The intake and exhaust ports are aligned with the intake and exhaust gas passages. The intake and exhaust ports have generally rectangular shapes to improve the rate of opening and closing the gas flow area of the ports. The sleeve is a cylindrical member having a cylindrical inner surface. The sleeve can be made of ceramic material.

A rotatable valving means having a valving combustion chamber open to both the piston chamber and the inner surface of the sleeve is rotatably located within each sleeve. Each valving means includes a rotary valve body located within the sleeve. The bottom of the valve body is located adjacent the head plate to reduce the thrust and lateral forces on the valve body. The opening in the head plate connects the valving combustion chamber with the piston chamber. The valve body has an outside cylindrical wall positioned in spaced contiguous relationship to the inside wall of the sleeve. The valve body is rotatably mounted on the head with low friction bearings. The valve body has a rotatable valving combustion chamber for accommodating air/fuel mixture and exhaust gases. A segment seal mounted on the valve body is located in sealing relation with the inside surface of the sleeve. Segment seal is a ceramic member drivably mounted on the valve body. The segment seal has limited radial movement so that it automatically maintains sealing engagement with the inner surface of the sleeve. In one form, segment seal has upper and lower pivot pins that extend into notches in the valve body. The pins allow the segment seal to pivot about an axis that is parallel to the inner surface of the sleeve. The segment seal includes a pressure activated ring seal which bears against the valve body to provide a minimum of friction of the segment seal with the sleeve and allows for the less stringent machining tolerances of the valve body. A second pressure activated seal is interposed between the head plate and bottom of the valve body.

The rotary valve assembly provides for an air/fuel stratification toward the outer portions of the valving combustion chamber when fuel is mixed with the air prior to or during intake. This enhances the ignition of the air/fuel mixture and allows for an overall relatively lean air/fuel mixture. The rotary valve body causes circulation and turbulence of the air/fuel mixture in the piston chamber. Pre-ignition and end gas detonations are reduced.

The rotary valve assemblies can be directly removed from the head. The head and its attendant intake and exhaust manifolds and cooling system need not be removed from the engine in order to provide access to the valve assemblies. Neither initial installation nor accumulated wear affects require adjustment of the valve parts. All fits and clearances are established by manufactured dimensions such that the initial assembly consists of simple synchronization indexing of the valve drive shaft and valve bodies.

DESCRIPTION OF PREFERRED EMBODIMENTS

Figure 1:
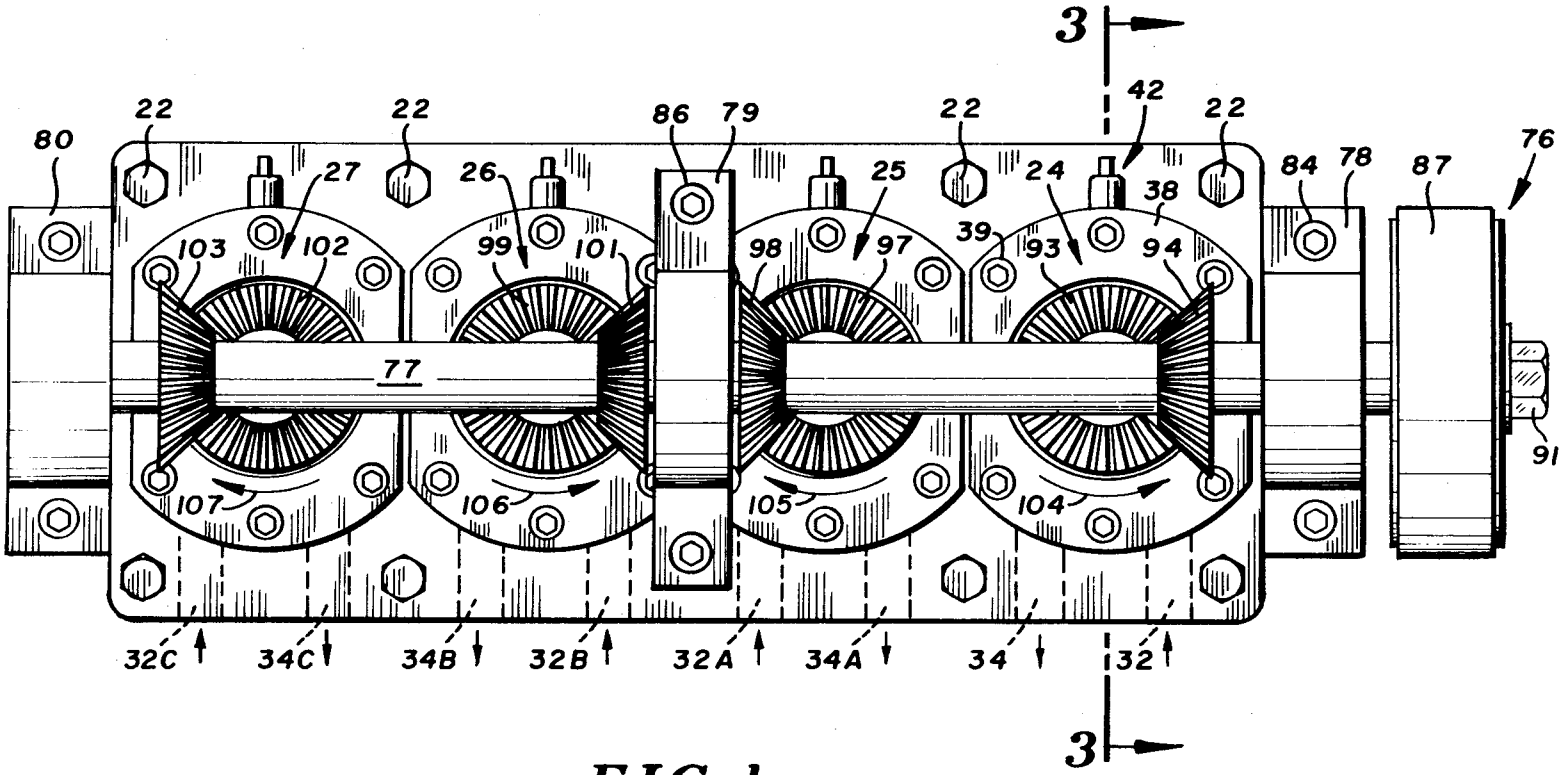
FIG. 1 is a top view of an internal combustion engine equipped with the rotary valve assemblies of the invention.
Figure 2:
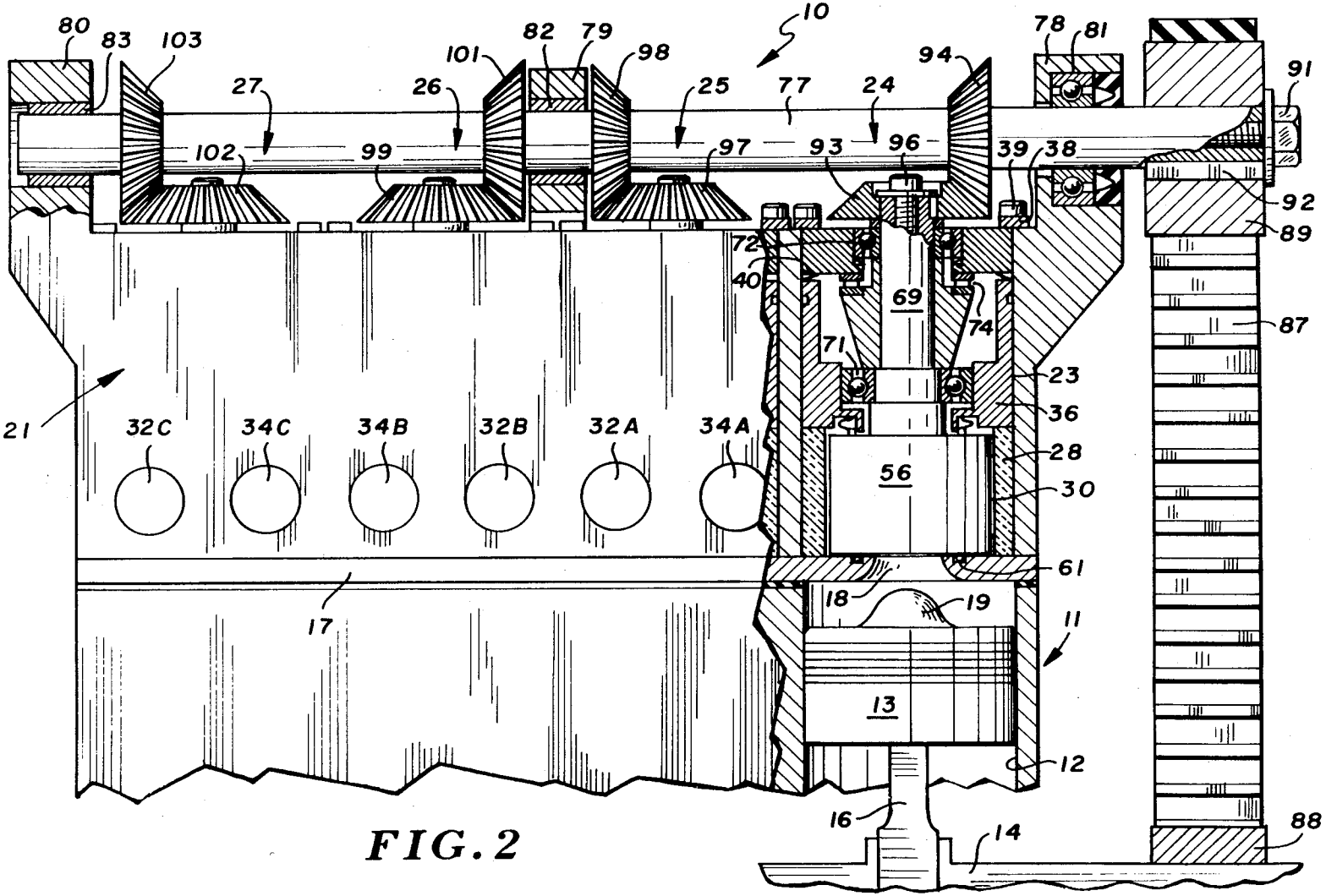
FIG. 2 is a side view, partly sectioned, of the engine of FIG. 1.

Referring to FIGS. 1 and 2, there is shown an internal combustion engine indicated generally at 10 equipped with rotary valve assemblies 24, 25, 26, and 27 having rotary valving combustion chambers. The air/fuel mixture in the rotary valving combustion chambers stratifies to allow effective ignition in lean burn environments. The air/fuel mixture in the rotary valving combustion chambers has circulation and turbulence providing an effective and efficient propagation of the flame front in the combustion chamber and piston chamber. Engine 10 has a block 11 having four upright cylinders or bores 12. The number of bores in block 11 can vary according to the design of the engine. Each of the bores accommodates a piston, such as piston 13. Piston 13 is slidably located in bore 12 and connected to a conventional crankshaft 14 with a connecting rod 16. As shown in FIG. 2, a head plate 17 is located on top of block 11. Head plate 17 has an opening 18 aligned with the central vertical axis of bore 12. Head plate 17 reduces the thrust and lateral forces on the valve assemblies and reduces the quenched volume of the air/fuel mixture adjacent to the valving combustion chambers. Substantially all of the air-fuel mixture in the valving combustion chambers is exposed to the flame front with a result in reduction of HC emissions and improved fuel economy. Piston 13 has an upwardly directed central projection 19 that is located in opening 18 when piston 13 is at top dead center or at the completion of the compression stroke. Projection 19 increases the compression of the air/fuel mixture in the rotary valving combustion chamber, and facilitates a generally cylindrical expanding flame front over the top of piston 13 during the power stroke. Pistons without projections 19 can be used in the internal combustion engine.

A head indicated generally at 21 is located on top of head plate 17. A plurality of head bolts 22 secure head 21 and head plate 17 to block 11. Head 21 has a plurality of vertical bores 23 accommodating rotary valve assemblies indicated generally at 24, 25, 26 and 27 for directing the flow of air/fuel mixture into the rotary valving combustion chambers, exposing the air/fuel mixture to an ignition spark, and controlling the flow of exhaust gases out of the valving combustion chambers and piston chambers. Rotary valve assemblies 24, 25, 26, 27 are identical in structure and function. The following description is directed to rotary valve assembly 24.

Figure 3:
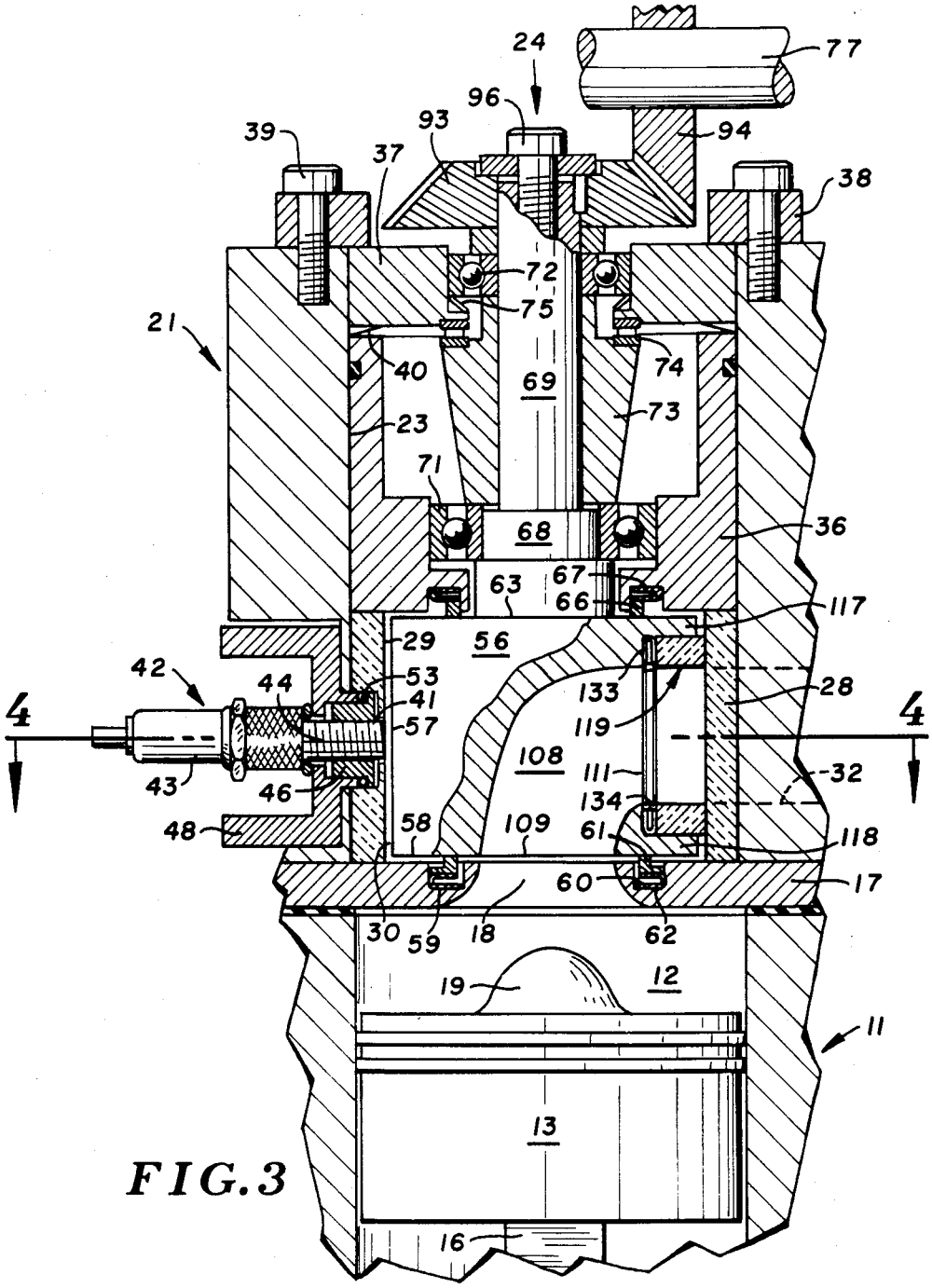
FIG. 3 is an enlarged sectional view taken along the line 3'3 of FIG. 1.
Figure 4:
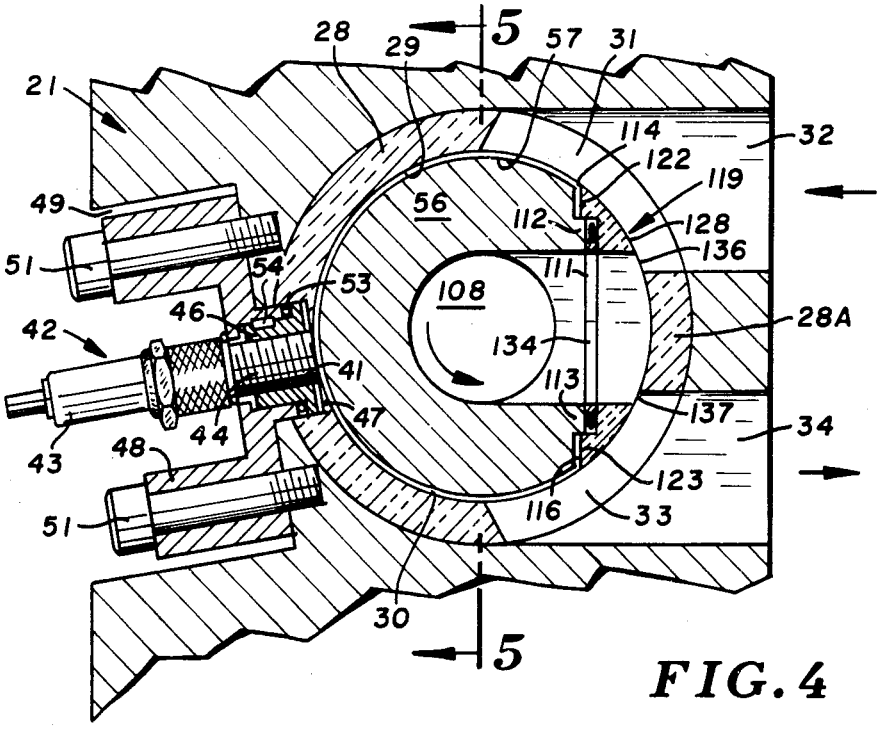
FIG. 4 is a sectional view taken along the line 4—4 of FIG. 3.

Referring to FIGS. 3 and 4, rotary valve assembly 24 has a cylindrical sleeve 28 positioned in the bottom of bore 23. The lower end of sleeve 28 bears against head plate 17. Sleeve 28 is a circular cylindrical member having an inside cylindrical surface 29, an intake port 31, and exhaust port 33. Intake port 31 is aligned with intake passage 32 located in head 21. Sleeve 28 can be removed from bore 23 to facilitate servicing and repair of the engine. The location of the edges of the sleeves forming the intake port 31 and exhaust port 33 can be changed to adjust the timing of the valve events as hereinafter described. Replacement of sleeve 28 with an alternative sleeve which has appropriate edge locations, such as vertical edges, allow the engine to be designed for different efficient operating speeds. Sleeve 28 can be a ceramic material, such as silicon, aluminum, oxygen, nitrogen, and other materials. A sleeve 28 of ceramic material functions as a head insulator to restrict the dissipation of heat to head 21. Sleeve 28 can also be made of other materials, such as metal, carbon or the like.

Returning to FIG. 2, head 21 has additional intake passages 32A, 32B, 32C and exhaust passages 34A, 34B, and 34C for the rotary valve assemblies 25, 26, and 27. Intake and exhaust manifolds (not shown) are used to supply an air/fuel mixture or air to the intake passages 32, 32A, 32B, and 32C and carry exhaust gases to an emission control and sound suppression device. Returning to FIG. 3, sleeve 28 is held in a fixed position against head plate 17 by members 36 and 37 located in bore 23. A spring washer 40 located between members 36 and 37 allows for thermal growth of head 21 relative to sleeve 28. A ring 38 surrounding member 37 holds members 36 and 37 and washer 40 in bore 23. A plurality of bolts 39 secure ring 38 to the top of head 21. Ring 38 is removable from head 21 to allow the entire valve assembly to be withdrawn from head 21. This is accomplished without removal of head 21 from block 11 or removal of the intake and exhaust manifolds.

Sleeve 28 has an ignition opening 41 generally opposite intake and exhaust ports 31 and 33. A spark plug 42 has its ignition end 44 located in hole 41 to ignite an air/fuel mixture. Spark plug 42 has a body and a threaded ignition end 44. As shown in FIG. 4, end 44 is threaded into a nut 46 located within an outer recess 47 in sleeve 28. The inner part of ignition end 44 is located substantially flush with the inside surface 29 of sleeve 28. Nut 46 is held in a support 48 located within a recess 49 in head 21. A plurality of bolts 51 secure support 48 to head 21. A ring seal 53 is interposed between nut 46 and support 48. A key 54 between nut 46 and support 48 prevents nut 46 from turning relative to support 48. Spark plug 42 when turned into nut 46 does not apply an axial load on sleeve 28 whereby the sleeve is not distorted. Nut 46 also prevents sleeve 28 from rotating in bore 23. Spark plug 42 can be replaced with a fuel injector (not shown) whereby the combustion would be compression ignition in the rotary valving combustion chamber. Alternatively, a fuel injection nozzle and spark plug can be used in lieu of spark plug 42 to provide a fuel injection engine with spark ignition for the air/fuel mixture in the rotary valving combustion chamber. An example of a suitable fuel injector and igniter is disclosed by Rank in U.S. Pat. No. 3,648,669.

Figure 5:
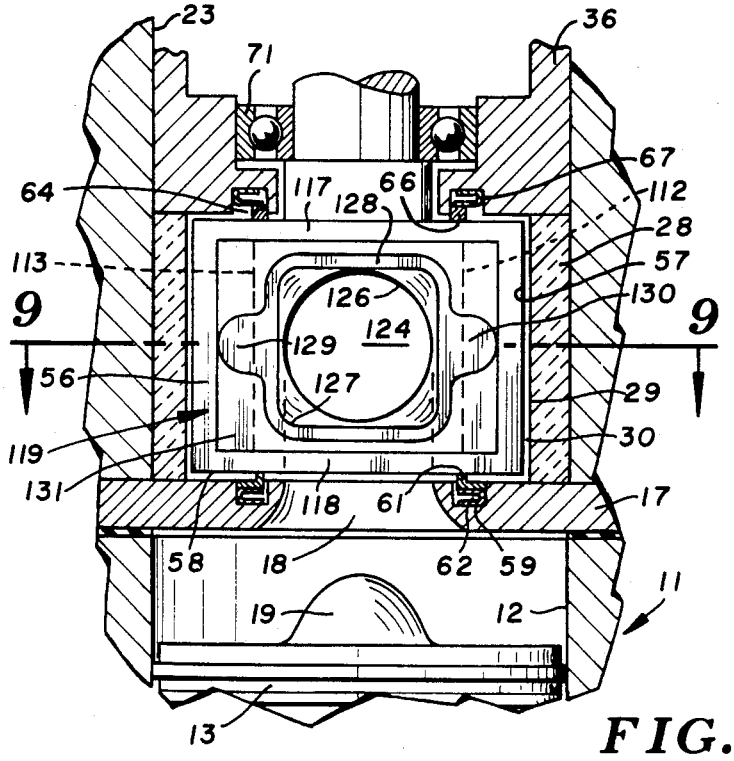
FIG. 5 is a sectional view taken along the line 5—5 of FIG. 4 with a side view of the rotary valve body and seal.

A cylindrical valve body 56 is located within sleeve 28. Body 56 has an outside cylindrical wall 57 located in spaced contiguous relation relative to inside wall 29 of sleeve 28. An annular cylindrical space 30 separates the outside cylindrical wall 57 of body 56 from inside wall 29 of sleeve 28. Wall 57 does not have a precise machine finish as it does not engage wall 29 of sleeve 28. There is no frictional relationship between the walls 57 and 29. The bottom of body 56 has a flat wall 58 facing head plate 17. Wall 58 can have a ceramic coating to enhance its wear characteristics. As shown in FIGS. 3 and 5, head plate 17 has a circular groove 59 surrounding opening 18. A ring seal 61 located in groove 59 is biased with a circular spring 62 into engagement with bottom wall 58 of body 56. Seal 61 is a pressure active face seal that has a high unit load on bottom wall 58 during the compression and power strokes of the piston. The high unit load is affected by transfer of high pressure gases in the annular seal chamber 60 surrounded by circular spring 62. Seal 61 is preferably ceramic material. Alternatively, a split ring located in an annular groove in head plate 17 engageable with seal 61 and a spring in the groove can be used to hold seal 61 in engagement with the bottom of body 56. Further, seal 61 can be replaced by a slit ring. A spring can be used to bias the split ring into engagement with the bottom of body 56.

Body 56 has a generally flat top wall 63 facing the bottom of member 36. Member 36 has a downwardly open circular groove 64 accommodating a sealing ring 66 and a circular spring 67. Spring 67 biases sealing ring 66 into sealing engagement with top wall 63. Sealing ring 66 can be a conventional circular oil seal.

A cylindrical hub integral with the top of body 56 is secured to an upright cylindrical shaft 69. A first low friction ball bearing 71 is interposed between hub 68 and member 56. A second ball bearing 72 is interposed between shaft 69 and member 37. Bearings 71 and 72 rotatably mount body 56 for rotation about a generally vertical axis aligned with the vertical axis of piston bore 12. A sleeve 73 surrounding shaft 69 is located between bearings 71 and 72. A thrust bearing 74 is interposed between sleeve 73 and member 37 to maintain the axial position of body 56 within sleeve 28 as shown in FIG. 3. An annular spring 75, such as a bevel washer, is located between member 57 and bearing 72. Spring 75 axially pre-loads valve body 56 against thrust bearing 74 to minimize impact forces on the bearings, allow for thermal growth, and allow for less stringent machining tolerance.

Returning to FIGS. 1 and 2, a valve body drive indicated generally at 76 is operable to rotate the valve bodies in a two to one timed relation with the rotation of crankshaft 14. Drive 76 has shaft 77 rotatably supported on top of head 21. Bearing supports 78, 79 and 80 accommodate bearings 81, 82 and 83 respectively for rotatably positioning shaft 77 longitudinally overhead 21. Bearings 81 or 82 can be a bidirectional thrust bearing to accommodate the axial loads on shaft 77. Bearing supports 78, 79 and 80 are two-part structures accommodating bearings 81, 82, and 83. Bolts 84 and 86 hold bearing support 78 and 79 on head 21. Shaft 77 is drivably connected to crankshaft 14 with an endless timing belt 87. Belt 87 is trained about a first tooth pulley 88 mounted on crankshaft 14 and a second tooth pulley mounted on shaft 77. A bolt 91 maintains pulley 89 on shaft 77. A key 92 drivably connects pulley 89 to shaft 77. Shaft 77 can be drivably connected to crankshaft 14 with a gear drive or chain drive. A pair of bevel gears 93 and 94 drivably connect shaft 77 to valve shaft 69. Bevel gear 93 is mounted on the upper end of shaft 69 and retained thereon with a bolt 96. Bevel gear 94 is fixed to shaft 77. Bevel gear pairs 97, 98, 99, 101, 102, and 103 are drivably connected to shaft 77 to the valve shafts of valve assemblies 25, 26 and 27 respectively. On rotation of shaft 77, the valve bodies of the valve assemblies 24–27 are rotated in the direction of the arrows 104, 105, 106 and 107 as shown in FIG. 1.

As shown in FIG. 3, valve body 56 has a valving combustion chamber or passage 108 for carrying air/fuel mixture to the piston compression and expansion chamber and exhausting exhaust gases therefrom. Passage 108 has a first open end 109 aligned with opening 18 in head plate 17. The opposite end 111 of passage 108 is open toward sleeve 28 and aligned with the intake and exhaust ports therein. As shown in FIG. 4, valve body 56 has a pair of upright shoulders 112 and 113 located adjacent opposite sides of open end 111. Upright grooves 114 and 116 are located adjacent the outer sides of shoulders 112 and 113. Shoulders 112 and 113 extend between a top lip 117 and a bottom lip 118 as shown in FIGS. 3 and 5.

A segment seal indicated generally at 119 is located between lips 117 and 118. Seal 119 has a pressure activated annular seal 133 that provides sealing forces proportional to the pressure acting within the seal on the surface of the segment seal located in engagement with sleeve 28. As the sealing forces increase, the contact unit loads increase correspondingly at all segment seal interfaces. Conversely, as the pressure acting within the segment seal decreases, the sealing force and resulting unit loads decrease. Seal 119 is free to move to accommodate relative run out between valve body 56 and ported sleeve 28 such that segment seal 119 maintains constant surface contact with the inside surface of the sleeve. Segment seal 119 insures that the annular clearance 30 between valve body 56 and the sleeve 28 is not filled with a fuel/air mixture. This substantially reduces the unburned fuel/air mixture in the valve assembly.

Figure 6:
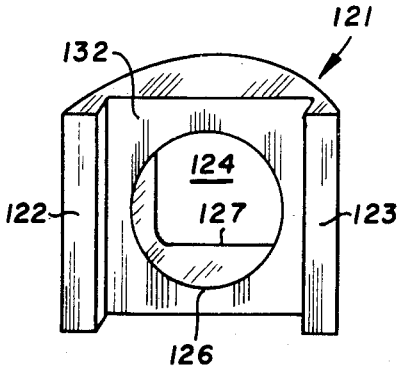
FIG. 6 is a perspective view of the seal for a rotary valve assembly of the engine of FIG. 1.
Figure 7:
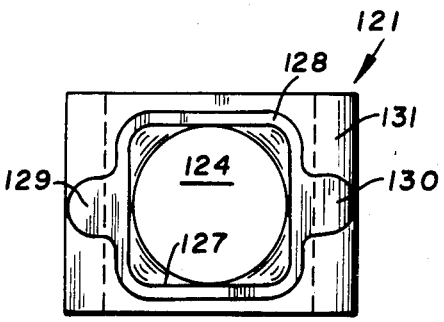
FIG. 7 is a front view of the seal of FIG. 6.
Figure 8:
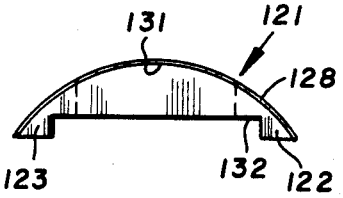
FIG. 8 is a top view of the seal of FIG. 6.

Referring to FIGS. 6 to 10, segment seal 119 has a onepiece ceramic body 121 having a pair of upright tongues 122 and 123. Tongues 122 and 123 project into grooves 114 and 116 and engage outer edges of shoulders 112 and 113. Body 121 has flat upper and lower surfaces that engage the top and bottom lips 117 and 118. Segment 119 has a center hole 124 in communication with valving combustion chamber 108. Center hole 124 has a circular inner end 126 and a generally square outer end 127. As shown in FIGS. 5 and 7, an arcuate outer surface 128 surrounds the square outer end 127. Arcuate surface 128 has lateral central arcuate extensions 129 and 130, which maintains gas-tight seals while body 121 transitions past ignition opening 41 in sleeve 28. The arcuate configurations of surfaces 128 to 130 generally conforms to the arcuate inner surface 29 of sleeve 28. As shown in FIG. 4, arcuate surface 128 is in surface contact with surface 29. The remaining outer surface of body 121 is a relieved arcuate surface 131. The surface 131 has a configuration such that it is not in surface contact with inner surface 29 of sleeve 28. FIG. 8 emphasizes the relief or separation of surface 131 relative to the surface of 128.

Figure 10:
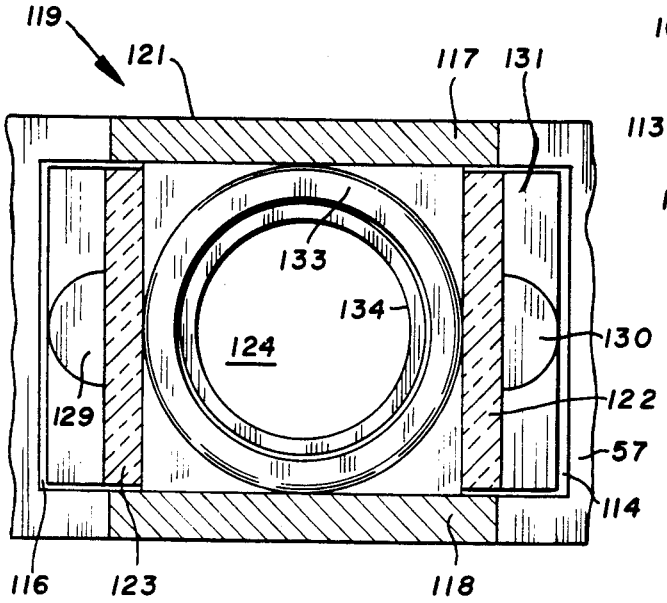
FIG. 10 is a sectional view taken along the line 10-10 of FIG. 9.
Figure 9:
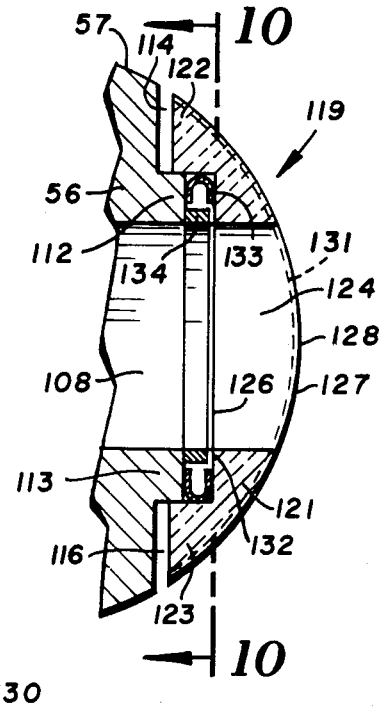
FIG. 9 is an enlarged sectional view taken along the line 9—9 of FIG. 5.

As shown in FIG. 6, body 121 has a flat inner wall 132 surrounding circular opening 126. Referring to FIGS. 9 and 10, a circular seal 133 is interposed between inner wall 132 and body 56. Seal 133 is a circular biasing seal member having a generally U-shaped cross section. Seal 133 functions to bias body 121 into sealing engagement with the inner surface 29 of sleeve 28. A circular band or shield 134 is located concentrically inside of circular seal 133 to minimize the accumulation of air/fuel mixture and exhaust gases between seal 119 and body 56, and to shield seal 133 from radiation heat transfer during combustion. Seal 133 and band 134 reduce the quenched volumes of the valve assembly. Alternatively, a split ring located in an annular groove in body 56 around chamber 108 engageable with segment body 121 and a spring in the groove can be used to hold segment body 121 in engagement with sleeve 28. The split ring can be used in conjunction with a continuous ring seal element.

Figure 11:
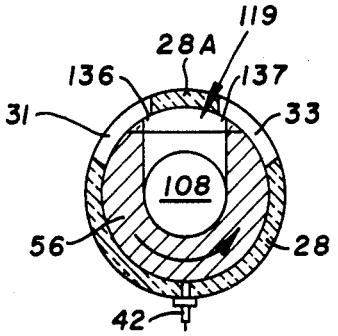
FIGS. 11 to 16 are diagrammatic views showing the rotary valve assembly porting events of the internal combustion engine of FIG. 1.

The sequence of events of valve assembly 24 are diagrammatically illustrated in FIGS. 11 to 16. FIG. 11 shows valve body 56 being rotated in a counter clockwise direction as indicated by the arrow. The valving combustion chamber 108 and segment seal 119 are located adjacent to intermediate segment 28A of sleeve 28 between intake port 31 and exhaust port 33. Valving combustion chamber 108 is larger than segment 28A providing for overlap openings 136 and 137 for the intake and exhaust ports 31 and 33 respectively. The overlap allows the intake gases to purge exhaust gases from the valving combustion chamber 108. The amount of overlap and the timing of the intake and exhaust episodes can be altered by changing the length of the intake and exhaust ports 31 and 33. In other words, the sleeve port edges can be changed to determine the timing of the valving events including the beginning of the intake, the end of the intake, the beginning of the exhaust and the end of the exhaust events. These alterations are made during the fabrication of the engine to provide an engine that has an optimum efficiency at a selected speed.

Figure 12:
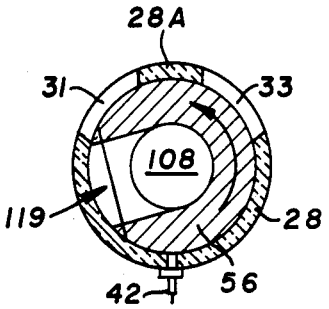
Figure 13:
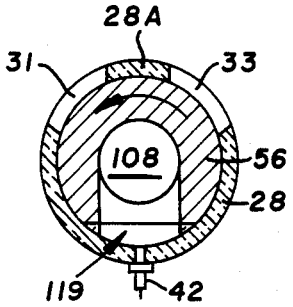
Figure 14:
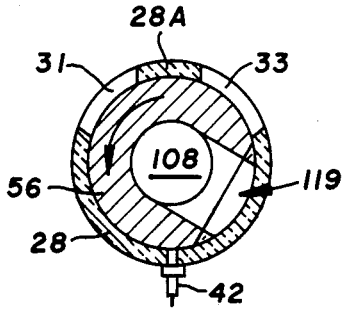
Figure 15:
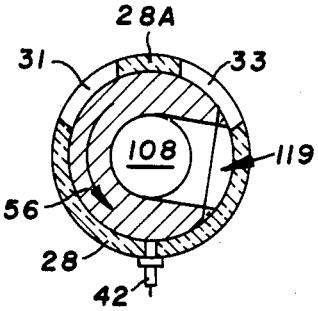
Figure 16:
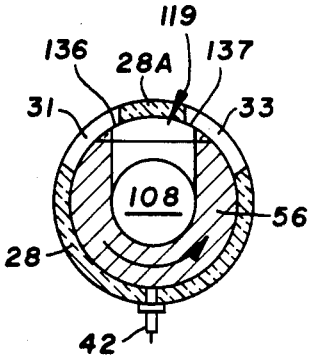

FIG. 12 shows valve body 56 at the completion of the intake stroke and the commencement of the compression stroke of the engine. The compression stroke is completed when valving body 56 is moved to the position shown in FIG. 13. The valving combustion chamber 108 is in alignment with the spark plug 42 and/or fuel injector. Spark plug 42 ignites the air/fuel mixture in valving combustion chamber 108 to commence the power or expansion stroke of the piston. FIG. 14 shows the position of valve body 56 during the power stroke. FIG. 15 shows the position of the valve body 56 during the opening episode of exhaust port 33. The valve body 56 continues to rotate whereby the exhaust gases are vented via exhaust port 33. FIG. 16 shows the position of valve body 56 at the completion of the exhaust stroke.

The ignition electrodes of spark plug 42 are shielded from the air/fuel mixture during compression thereof in the valving combustion chamber 108. The only time that the spark plug 42 is exposed to the valving combustion chamber 108 is when valve body 56 is in the position shown in FIG. 13. This provides a shielding of hot spot sources which reduces pre-ignition and/or detonation. The rotating valve body 56 with valving combustion chamber 108 provides for stratification of the air/fuel mixture due to the centrifugal effects of the richer portion of the mixture toward spark plug 42. This improves the lean burn combustion of the air/fuel mixture in valving combustion chamber 108. The rotating valve body 56 also increases the turbulence of the air/fuel mixture which decreases the potential for detonation.

Piston 13 with its head projection 19 increases the compression ratio of the engine. Projection 19 also provides for turbulent movement of air/fuel mixture in valving combustion chamber 108. Piston 13 imparts squish turbulence of the air/fuel mixture above the piston as the piston approaches head plate 17. This reduces detonation and enhances the efficient combustion of the air/fuel mixture.

The pressure activated seals 61 and 119 operatively associated with rotating valve body 56 generate only the necessary sealing contact unit loads required to effect efficient seals. The seals 61 and 119 have a minimum of sliding friction while allowing for run-out or wear-in during the operation of the valve assembly. In use, the pressure active seals 61 and 119 are allowed to float with respect to the valve body 56. This provides for the economy of relaxed fabrication tolerances while accommodating thermal growth and valve assembly run-out. Seal 61 and 119 are located relative to the valve body 56 to allow clearance between valve body 56 and the inside surface 29 of sleeve 28 and head plate 17. This clearance or space 30 does not accommodate an air/fuel mixture thereby reducing the amount of quenched air/fuel mixture in valving combustion chamber 108, and reduces the bearing loads on shaft 69 by reducing the pressure loaded area of valve body 56. The geometry of the valve assembly allows the intake and exhaust gases to flow to and from the working or piston chamber with minimal restrictions. The initial installation and accumulated wear affects on the valve assemblies do not require adjustment. All the fits and clearances are established by manufacturing dimensions.

The rotary valve assembly 24 is designed to provide for direct removal from the head 21. This is accomplished by removing the drive shaft 77 along with the bevel gears 94, 98, 101, and 103 mounted thereon. Ring 38 is removed from head 21. The valve body 56, along with sleeve 28, can be withdrawn upwardly from the bore 23 in head 21. The spark plug support 48 is removed from the head to permit the removal of sleeve 28. This can be accomplished without removing intake and exhaust manifolds and the cooling system from the engine.

Figure 17:
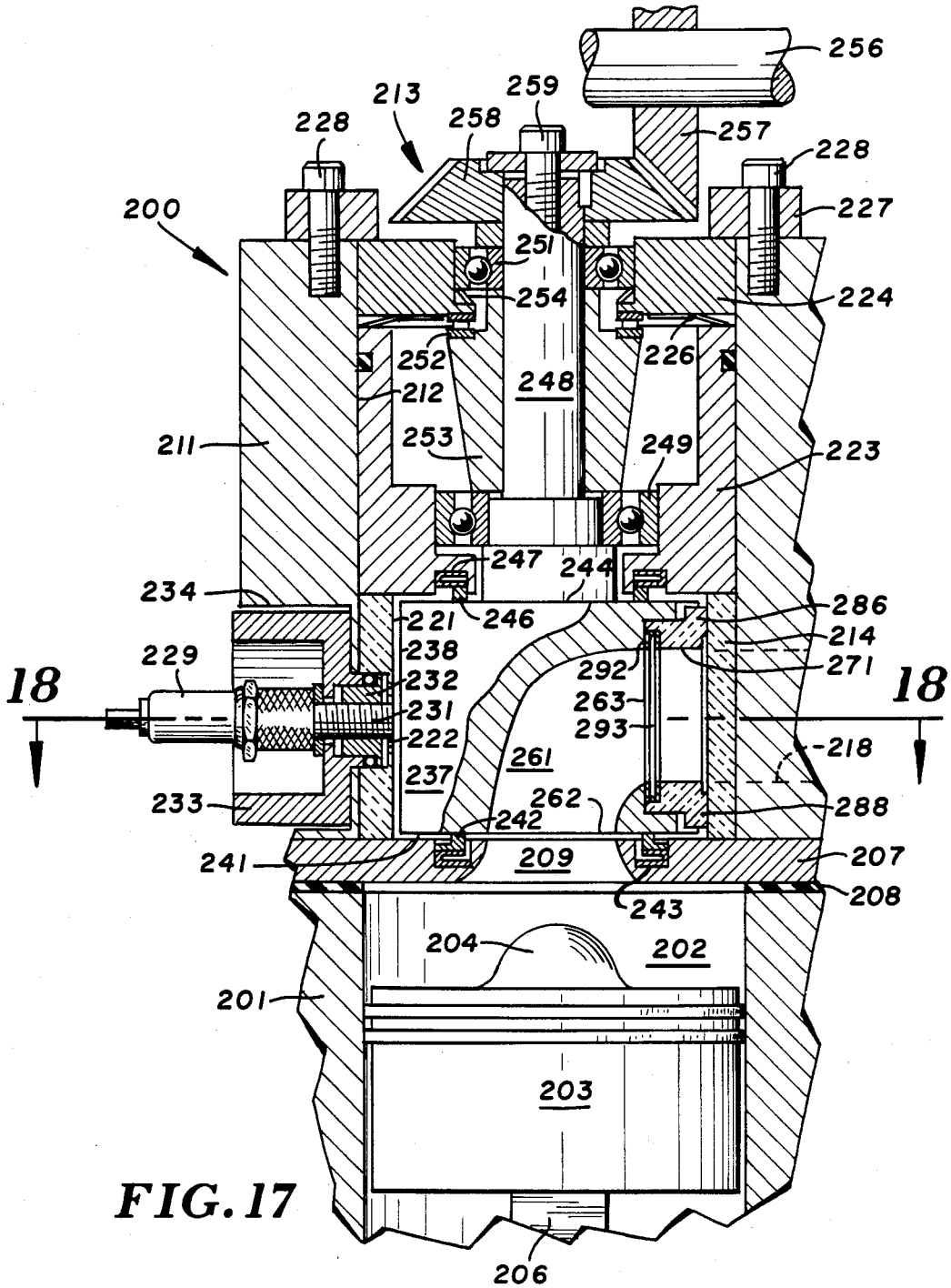
FIG. 17 is a sectional view similar to FIG. 3 of a modification of the rotary valve of the invention.
Figure 18:
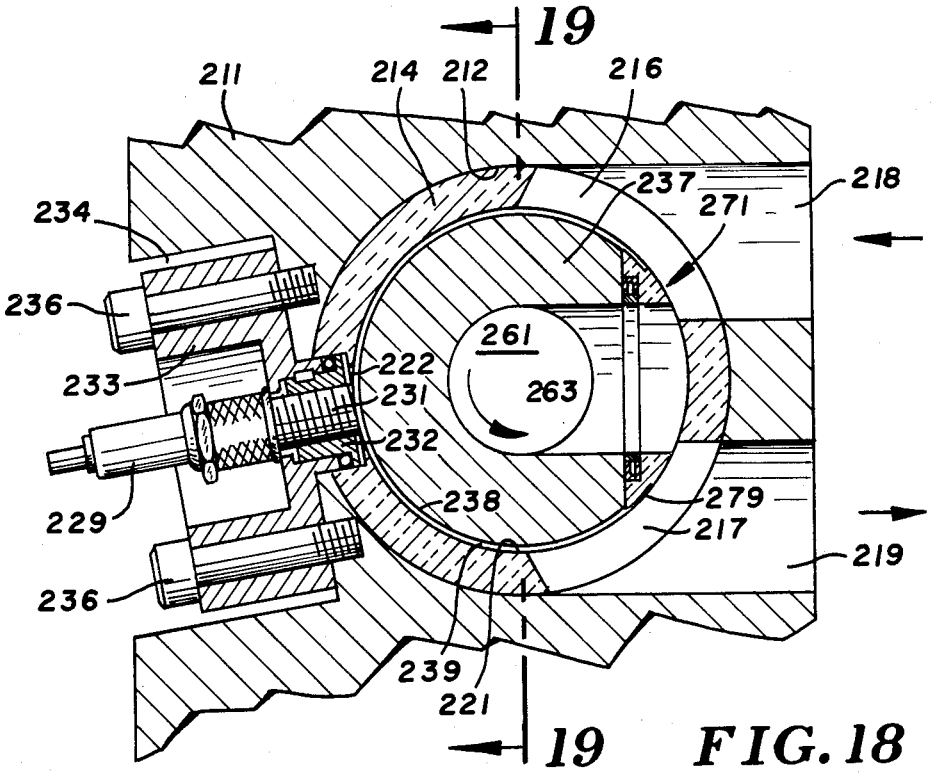
FIG. 18 is a sectional view taken along the line 18—18 of FIG. 17.

Referring to FIG. 17, there is shown an internal combustion engine indicated generally at 200 of the type shown in FIGS. 1 and 2 herein. Engine 200 has a block 201 having a cylinder 202. A reciprocating piston 203 is located in cylinder or chamber 202. The top of piston 203 has an upwardly directed projection 204. A connecting rod 206 operatively joins piston 203 with the engine crankshaft (not shown). Engine 200 can have additional cylinders in block 201 and associated pistons connected to the crankshaft. A head plate 207 having an opening 209 is located over block 201. A gasket 208 is interposed between head plate 207 and the top of block 201. Headbolts (not shown) are used to secure head 211 and plate 207 to block 201. Head 211 is a metal body having a vertical bore 212 aligned with opening 209 in head plate 207. A rotary valve assembly indicated generally at 213 is operatively positioned in vertical bore 212 to control the flow of intake air/fuel mixture to the compression and expansion to chamber 202 and the exhaust gases therefrom. An annular sleeve 214 of ceramic material is located in bore 212 immediately above head plate 207. As shown in FIG. 18, sleeve 214 has an intake port 216 aligned with an intake passage 218 in head 211. Sleeve 214 has an exhaust port 217 circumferentially spaced from intake port 216. Exhaust port 217 is aligned with an exhaust passage 219 in head 211. Intake passage 218 and exhaust passage 219 are located in head 211 for carrying air and fuel from an intake manifold to rotary valve assembly 213 and carry exhaust gases from rotary valve assembly 213 to an exhaust manifold.

Sleeve 214 has an inside cylindrical surface 221 that is interrupted by the circumferentially spaced intake and exhaust ports 216 and 217 respectively and an ignition port 222. Sleeve 214 is preferably made of a one-piece ceramic material such as silicon nitrate, silicon carbide or a ceramic including silicon, aluminum, oxygen, nitrogen, and other materials including fibers. Sleeve 214 functions as a heat insulator to restrict the dissipation of heat to head 211. Sleeve 214 can be made of other materials such as metal, Pyrolite carbon, or the like.

Returning to FIG. 17, sleeve 214 is held in a fixed position against head 207 by a collar 223 and a ring 224 located in vertical bore 212. A spring washer 226 is located between the collar 223 and ring 224 to allow for thermal growth of head 211 relative to sleeve 214. An annular plate 227 located on top of head 211 engages ring 224. A plurality of bolts 228 secure plate 227 to head 211 to hold collar 223, ring 224, and sleeve 214 in assembled relation with head 211. Bolts 228 can be removed from head 211 to allow collar 223, ring 224, and sleeve 214 to be removed from head 211. This allows the entire valve assembly 213 to be removed from head 211 for servicing and replacement without the removal of head 211 from block 201 or removal of intake and exhaust manifolds.

A spark plug 229 has an ignition end 231 located in ignition port 222. End 231 is threaded into a nut 232 mounted on a support 233. Support 233 is located within a recess 234 in head 211. The inner part of ignition end 231 is located substantially flush with the inside surface 221 of sleeve 214. As seen in FIG. 18, a plurality of bolts 236 secure support 233 to head 211. Spark plug 229 threaded into nut 231 does not apply an axial load on sleeve 214. This prevents distortion of sleeve 214 and ensures a continuous circular sealing surface 221 on sleeve 214. Spark plug 229 can be replaced with a fuel injector or a combined fuel injection nozzle and spark plug to provide a fuel injection engine with spark ignition for the air/fuel mixture within the rotary valving combustion chamber.

A cylindrical valve body 237 is located within sleeve 214. Body 237 has an outside cylindrical wall 238 that is spaced inwardly from inside surface 221 of sleeve 214. As shown in FIG. 18, a continuous annular space 239 provides clearance between the body 237 and sleeve 214. Outside wall 238 of body 237 does not have a precise machine finish as it has an annular clearance with respect to the inside wall of sleeve 214. Body 237 has a flat bottom wall 241 that is engaged with a ring seal 242. A spring mounted on head plate 207 biases ring seal 242 into sealing engagement with bottom wall 241. Seal 242 is a pressure active face seal that has a high unit load on bottom wall 241 during the compression and power strokes of piston 203. Seal 242 is preferably a ceramic ring.

Body 237 has a generally flat top wall 244 facing the bottom of collar 223. A sealing ring 246 is interposed between collar 223 and top wall 244. A spring 247 biases seal ring 246 into engagement with top wall 244. Seal ring 247 can be a conventional circular oil seal.

An upwardly directed shaft 248 is secured to the top of body 237. A bearing 249 surrounding shaft 248 rotatably mounts shaft 248 and body on collar 233. A second bearing 251 rotatably mounts the upper end of shaft 248 on ring 224. A thrust bearing 252 is interposed between a sleeve 253 and ring 224 to maintain the axial position of body 237 within sleeve 214. Sleeve 253 surrounding shaft 248 is located between and engages the bearings 249 and 251. An annular spring 254, such as a bevel washer, is located between ring 224 and bearing 251. Spring 254 axially pre-loads valve body 237 against thrust bearing 252 to minimize impact forces on the bearing 252, allow for thermal growth of the metal ports, and allow for less stringent machining tolerance.

As shown in FIG. 17, valve body 237 is drivably connected to a shaft 256 with a pair of beveled gear 257 and 258. Gear 258 mounted on top of shaft 248 is secured thereto with a bolt 259. Shaft 256 is connected in a timed relation to the crankshaft (not shown) of the engine. Shaft 256 is operable to rotate valve body 237 in a two-to-one timed relation with the rotation of the crankshaft.

Figure 25:
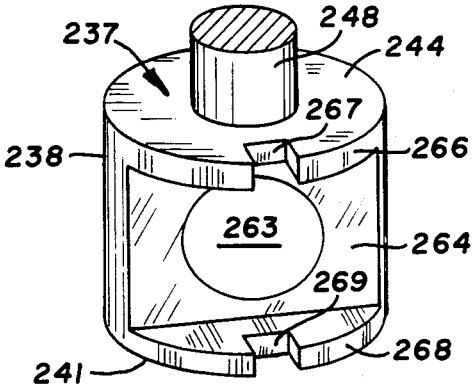
FIG. 25 is a perspective view of the valve body of the rotary valve.

Valve body 237 has a valving combustion chamber 261 with an open first end 262 located over an aligned opening 209 in head plate 207 and an open second end 263 aligned with and open to intake, exhaust, and ignition ports in sleeve 214. Body 237 is a one-piece generally cylindrical member made of metal, ceramic, and like materials, As shown in FIG. 25, body 237 has a groove or recess 264 extended transversely between an arcuate top wall 266 and an arcuate top wall 268. The center portion of wall 266 has a radially inwardly directed notch or recess 267 aligned with a radially directed notch or recess 269 in bottom wall 268.

Figure 19:
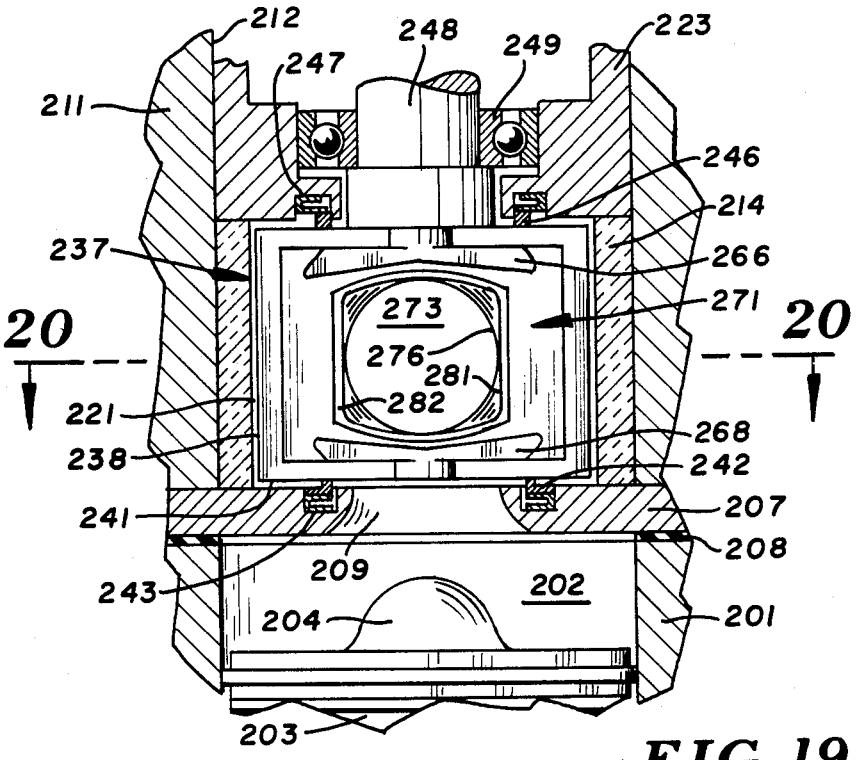
FIG. 19 is a sectional view taken along the line 19'19 of FIG. 18.

As shown in FIG. 19, a segment seal indicated generally at 271 is located between the top and bottom walls 266 and 268 in groove 264. Segment seal 271 is a pressure activated seal that provides sealing forces proportional to the pressure acting within the seal on the surfaces of the seal segment located in sliding engagement with the inside cylindrical surface 221 of sleeve 214. As the sealing portion is increased, the contact unit loads increase correspondingly at all segment seal interfaces with sleeve 214. Conversely, as the pressure acting within the segment decreases, the sealing force and resulting unit loads increase. Seal 271 is free to move to accommodate relative run-out between valve body 237 and the ported sleeve 214. Segment seal 271 is free to rotate about an axis parallel to the inside surface 221 as the seal moves around the surface 221. The segment seal also has limited movement in a radial direction such that segment seal 271 maintains constant surface sealing contact with inside cylindrical surface 221 of sleeve 214. Segment seal 271 ensures that the annular clearance between valve body 237 and sleeve 214 is not filled with an air/fuel mixture. This substantially reduces the unburned fuel/air mixture in the valve assembly.

Figure 22:
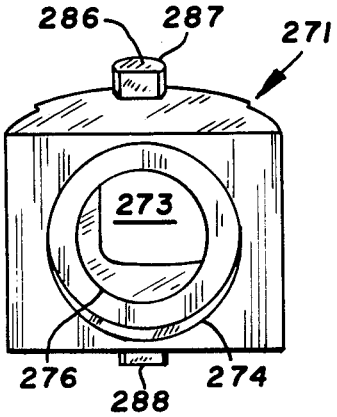
FIG. 22 is a perspective view of the inside face of the segment seal of the rotary valve.
Figure 23:
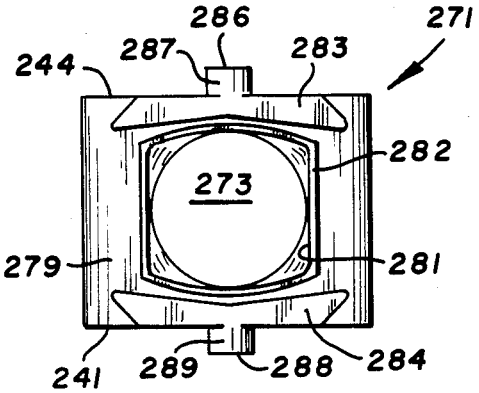
FIG. 23 is a front view of the outside face of the segment seal of the rotary valve.
Figure 24:
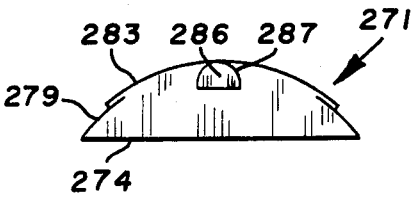
FIG. 24 is a top view of the segment seal of the rotary valve.

Referring to FIGS. 22, 23, and 24, segment seal 271 is a one-piece ceramic body 272 having a central passage 273 extended between back wall 274 and the convex curved front wall 279. A circular opening 276 in back wall 274 surrounds passage 273. Back wall 274 has a circular recess 277 around passage 273 for accommodating a circular seal 292. As shown in FIGS. 23 and 24, front wall 279 has an arcuate segment or convex curved shape having a central generally square opening 281 surrounding passage 273. Opening 281 is in alignment with the square intake and exhaust port openings 216 and 217 in sleeve 214. This provides rapid opening and closing of the intake and exhaust ports. The vertical dimension of the passageway between the segment seal 271 and intake and exhaust ports 216 and 217 is constant during the entire opening and closing episodes.

A peripheral continuous sealing surface 282 surrounds opening 281. Surface 282 is located between upper and lower lands 283 and 284 on front wall 279. Lands 283 and 284 are arcuate bands or flat ribs located above and below surface 282. The top of land 283 terminates at top surface 244 of body 237. The bottom of land 284 terminates at bottom surface 241 of body 237. The peripheral sealing surface 282 and lands 283 and 284 project away from wall 279 and are located in sliding and sealing engagement with the inside cylindrical surface 221 of sleeve 214. The remaining portions of front wall 279 are relieved to provide a small clearance from the surface 221. This reduces the amount of material of segment seal 271 that is in sliding contact with sleeve 214.

As shown in FIGS. 19, 22, 23 and 24, segment seal 271 has upper and lower projections or pins 286 and 288 that fit into notches 267 and 269 respectively. Projection 286 has a arcuate convex curved face 287 having a central portion that is co-extensive with the outer surface of land 283. Projection 288 has a similar convex curved face 289 co-extensive with the outer surface of land 284. Faces 287 and 289 are adapted to engage the inside cylindrical surface 221 of sleeve 218 to permit the segment seal 271 have limited swinging or pivotal movement, as indicated by the arrow 291 in FIG. 20, about an axis parallel to the inside surface 221 of sleeve 214.

Figure 20:
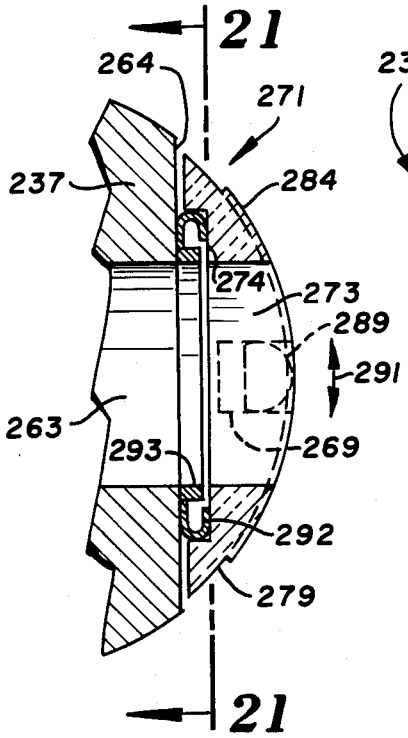
FIG. 20 is a sectional view taken along the line 20—20 of FIG. 19.
Figure 21:
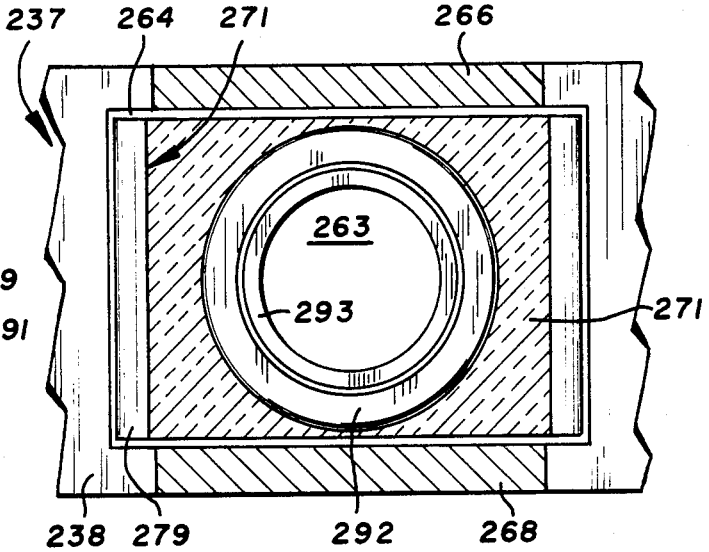
FIG. 21 is a sectional view taken along the line 21—21 of FIG. 20.

Referring to FIGS. 20 and 21, a circular seal 292 having a generally U-shaped cross section is interposed between back wall 274 and the bottom of groove 264 of body 237. Seal 292 is a circular biasing seal member which functions to bias segment seal 271 into sealing engagement with the inner surface 221 of sleeve 214. A circular band or shield 293 located concentrically inside seal 292 minimizes the accumulation of air/fuel mixture and exhaust gases between seal 292 and body 272 and shields seal 292 from radiation heat transferred during combustion. Seal 292 and band 293 reduce the quenched volumes of the rotary valve assembly. A split ring, adjacent back wall 274 can be used to hold the segment seal 271 in sealing engagement with the inside surface 221 of sleeve 214.

While there has been shown and described preferred embodiments of the internal combustion engine and rotary valve assembly, it is understood that changes in the structure, materials, and arrangement of structure can be made by those skilled in the art without departing from the invention. The invention is defined in the following claims.

The embodiments of the invention in which an exclusive property or privilege is claimed are defined as follows:

1. A rotary valve assembly comprising: a housing having a bore, a gas inlet passage and a gas outlet passage open to the bore, a continuous cylindrical sleeve means located in said bore, said sleeve means having an inner surface and ports aligned with said passages, rotatable means located within said sleeve means for controlling the flow of gas into and out of the assembly, said rotatable valving means having a valving chamber open to means to accommodate a gas and the inner surface of the sleeve means, said rotatable valving means having a valve body, said valving chamber having an inner portion located in the valve body, said valve body having an outer surface spaced from the inner surface of the sleeve means, segment seal means mounted on the valve body for rotation therewith, said segment seal means being engageable with the inner surface of the sleeve means, said segment seal means having a hole aligned with an outer portion of the valving chamber, cooperating pin and slot means on said segment seal means and valve body to move the segment seal means with the valve body and allow the segment seal means to move about an axis generally parallel to said inner surface of the sleeve means, biasing means located between the valve body and segment seal means to hold the segment seal means into engagement with the inner surface of the sleeve means, and means operable to rotate said rotatable valving means whereby said valving passage sequentially moves into alignment with said ports allowing gas to flow in said inlet and outlet gas passages.

2. The assembly of claim 1 wherein: the cylindrical sleeve means is a ceramic member.

3. The assembly of claim 2 wherein: the segment seal means is a ceramic member.

4. The assembly of claim 1 wherein: the cylindrical sleeve means has a cylindrical inside surface and the segment seal means is a member having an outside surface portion engageable with the inside surface of the sleeve means.

5. The assembly of claim 4 wherein: said member has a first outside surface portion surrounding the outer portion of the valving chamber engageable with the inside surface of the sleeve means, and a second outside surface portion adjacent the first outside surface portion spaced from the inside surface of the sleeve means.

6. The assembly of claim 1 wherein: said valve body has a circumferential outwardly directed upper lip and a lower lip, said segment seal means being located between said lips, said cooperating pin and slot means comprising a slot in each lip and pin means secured to the valve body extended into the slots.

7. The assembly of claim 6 wherein: said biasing means comprises circular spring means surrounding the valve passage and engageable with the valve body and segment seal means, said spring means also providing a seal between the body and segment seal means.

8. The assembly of claim 7 wherein: said segment seal means has tongues adjacent opposite sides of the valve body passage, said spring means being located between said tongues.

9. The assembly of claim 7 including: a ring shield means located inwardly of the circular spring means between the valve body and segment seal means.

10. The engine of claim 1 wherein: the axis of movement of segment seal means is generally parallel to the axis of rotation of the valve body.

11. The assembly of claim 1 wherein: said segment seal means has an outside surface portion surrounding the outer portions of the valving passage and engageable with the inside surface of the housing, and land means located adjacent the outside surface portion engageable with the inside surface of the housing.

12. The assembly of claim 11 wherein: said segment seal means has outside surface sections located around the outside surface portions and land means spaced from said inside surface of the housing.

13. A rotary valve assembly comprising: housing means having an inner surface and fluid inlet and outlet ports open to the inner surface, rotatable means located within the housing means for controlling the flow of fluid into and out of the assembly, said rotatable valving means having a valving chamber open to means to accommodate a fluid, said rotatable valving means having a valve body, said valve body having an outer surface spaced from the inner surface of the housing means, segment seal means mounted on the valve body engageable with said inner surface of said housing means, said segment seal means having a passage in communication with the second chamber and open to said inner surface to allow fluid to flow into and out of said chamber, cooperating pin and slot means on said segment seal means and valve body to move the segment seal means with the valve body and allow the segment seal means to move about an axis generally parallel to said inner surface of the housing means, biasing means located between the segment valve body and seal means to hold the segment seal means into engagement with the inner surface of the housing means, and means operable to rotate said valve body whereby said valving chamber sequentially moves into alignment with said ports allowing fluid to flow in said fluid inlet and outlet ports into and out of said chamber in the valve body.

14. The assembly of claim 13 wherein: the segment seal means is a ceramic member.

15. The assembly of claim 13 wherein: said segment seal means has a first outside surface portion surrounding the outer portion of the valving passage engageable with the inside surface of the housing means, and a second surface portion adjacent the first outside surface portion spaced from said inside surface of the housing means.

16. The assembly of claim 13 wherein: said housing means includes a sleeve having said inner surface, said sleeve having said fluid inlet port and said fluid outlet port.

17. The assembly of claim 16 wherein: said segment seal means is a ceramic member and said sleeve is a cylindrical ceramic member.

18. The assembly of claim 13 wherein: said valve body has a circumferential outwardly directed upper lip and a lower lip, said segment seal means being located between said upper and lower lips, said cooperating pin and slot means comprising a slot in each lip and pin means secured to the valve body extended into the slots.

19. The assembly of claim 13 wherein: said segment seal means has an outside surface portion surrounding the outer portion of the valving passage engageable with the inner surface of the housing means, and land means located adjacent the outside surface portion engageable with the inner surface of the housing means.

20. The assembly of claim 19 wherein: said segment seal means has outside surface sections located around the outside surface portions and land means spaced from said inside surface of the housing means.

21. The assembly of claim 13 wherein: said biasing means comprises circular spring means surrounding the valve passage and engageable with the valve body and segment seal means, said spring means also providing a seal between the valve body and segment seal means.

22. The assembly of claim 21 wherein: said segment seal means has tongues adjacent opposite sides of the passage, said spring means being located between said tongues.

23. The assembly of claim 21 including: ring seal means located inwardly of the circular spring means between the valve body and segment seal means.

24. The assembly of claim 13 wherein: the axis of movement of the segment seal means is generally parallel to the axis of rotation of the valve body.

25. A rotary valve assembly comprising: housing means having a cylindrical surface and fluid inlet and outlet ports open to the inner surface, rotatable means located within the housing means for controlling the flow of fluid into and out of the assembly, said rotatable valving means having a valving chamber open to means to accommodate a fluid, said rotatable valving means having a valve body, said valve body having a cylindrical outer surface spaced from the cylindrical inner surface of the housing means, segment seal means mounted on the valve body engageable with said cylindrical inner surface of said housing means, said segment seal means having a passage in communication with the second chamber and open to said cylindrical inner surface to allow fluid to flow into and out of said chamber, cooperating means on said segment seal means and valve body to move the segment seal means with the valve body and allow the segment seal means to move about an axis generally parallel to said cylindrical inner surface of the housing means, biasing means located between the valve body and segment seal means to hold the segment seal means into engagement with the cylindrical inner surface of the housing means, and means operable to rotate said valve body whereby said valving chamber sequentially moves into alignment with said ports allowing fluid to flow in said fluid inlet and outlet ports into and out of said chamber in the valve body.

26. The assembly of claim 25 wherein: the segment seal means is a ceramic member.

27. The assembly of claim 25 wherein: said segment seal means has a first outside surface portion surrounding the outer portion of the valving passage engageable with the cylindrical inside surface of the housing means, and a second surface portion adjacent the first outside surface portion spaced from said cylindrical inside surface of the housing means.

28. The assembly of claim 25 wherein: said housing means includes a sleeve having said cylindrical inner surface, said sleeve having said fluid inlet port and said fluid outlet port.

29. The assembly of claim 28 wherein: said segment seal means is a ceramic member, and said sleeve is a cylindrical ceramic member.

30. The assembly of claim 25 wherein: said valve body has a circumferential outwardly directed upper lip and a lower lip, said segment seal means being located between said upper and lower lips, said cooperating means comprising a slot in each lip and pin means secured to the valve body extended into the slots.

31. The assembly of claim 25 wherein: said segment seal means has an outside surface portion surrounding the outer portion of the valving passage engageable with the cylindrical inner surface of the housing means, and land means located adjacent the outside surface portion engageable with the cylindrical inner surface of the housing means.

32. The assembly of claim 25 wherein: said biasing means comprises circular spring means surrounding the valve passage and engageable with the valve body and segment seal means, said spring means also providing a seal between the valve body and segment seal means.

33. The assembly of claim 32 including: said segment seal means has tongues adjacent opposite sides of the passage, said spring means being located between said tongues.

34. The assembly of claim 32 including: ring seal means located inwardly of the circular spring means between the valve body and segment seal means.

35. The assembly of claim 25 wherein: the axis of movement of the segment seal means is generally parallel to the axis of rotation of the valve body.

* * * * *